US010903575B2

(12) United States Patent
Hara et al.

(10) Patent No.: US 10,903,575 B2
(45) Date of Patent: Jan. 26, 2021

(54) ANTENNA MODULE

(71) Applicant: TDK CORPORATION, Tokyo (JP)

(72) Inventors: Yasuyuki Hara, Tokyo (JP); Naoki Sotoma, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/126,065

(22) Filed: Sep. 10, 2018

(65) Prior Publication Data

US 2019/0089060 A1 Mar. 21, 2019

(30) Foreign Application Priority Data

Sep. 20, 2017 (JP) ..... 2017-179889

(51) Int. Cl.

| | |
|---|---|
| ***H01Q 1/50*** | (2006.01) |
| ***H01Q 9/04*** | (2006.01) |
| ***H01Q 21/06*** | (2006.01) |
| *H01Q 1/48* | (2006.01) |
| *H01Q 1/38* | (2006.01) |
| *H01Q 21/24* | (2006.01) |
| *H01P 5/18* | (2006.01) |
| *H01Q 3/26* | (2006.01) |

(52) U.S. Cl.

CPC ..... *H01Q 9/0457* (2013.01); *H01Q 21/061* (2013.01); *H01Q 21/065* (2013.01); *H01P 5/187* (2013.01); *H01Q 1/38* (2013.01); *H01Q 1/48* (2013.01); *H01Q 3/267* (2013.01); *H01Q 9/0414* (2013.01); *H01Q 9/0435* (2013.01); *H01Q 21/24* (2013.01)

(58) Field of Classification Search

CPC .. H01Q 9/0457; H01Q 21/061; H01Q 21/065; H01Q 1/38; H01Q 1/50

USPC ..... 343/850

See application file for complete search history.

(56) References Cited

U.S. PATENT DOCUMENTS

| | | | | |
|---|---|---|---|---|
| 2004/0027285 | A1* | 2/2004 | Fang | H01Q 9/0414 343/700 MS |
| 2006/0055601 | A1 | 3/2006 | Kameda et al. | |
| 2010/0164783 | A1* | 7/2010 | Choudhury | H01Q 3/26 342/175 |
| 2013/0063310 | A1 | 3/2013 | Mak et al. | |

(Continued)

FOREIGN PATENT DOCUMENTS

| | | | |
|---|---|---|---|
| CN | 1747226 | A | 3/2006 |
| JP | 59-169203 | A | 9/1984 |

(Continued)

*Primary Examiner* — Huedung X Mancuso
(74) *Attorney, Agent, or Firm* — Young Law Firm, P.C.

(57) ABSTRACT

Disclosed herein is an antenna device that includes a circuit layer having a filter circuit, an antenna layer stacked on the circuit layer and having a radiation conductor, a feed layer positioned between the circuit layer and the antenna layer and having a first feed pattern connected to the filter circuit and electromagnetically coupled to the radiation conductor, a first ground pattern provided between the antenna layer and the feed layer, and a second ground pattern provided between the circuit layer and the feed layer. The first and second ground patterns have first and second slots, respectively, at least partially overlapping each other as viewed in a stacking direction. The first feed pattern at least partially overlaps the radiation conductor and the first and second slots.

16 Claims, 13 Drawing Sheets

(56) References Cited

U.S. PATENT DOCUMENTS

| | | | | |
|---|---|---|---|---|
| 2015/0091760 | A1* | 4/2015 | Sawa | H01Q 19/005 343/700 MS |
| 2016/0211585 | A1* | 7/2016 | Chau | H01Q 9/285 |
| 2018/0123245 | A1* | 5/2018 | Papio Toda | H01Q 21/0075 |

FOREIGN PATENT DOCUMENTS

| | | | |
|---|---|---|---|
| JP | 5-21514 | A | 3/1993 |
| JP | 10-303640 | A | 11/1998 |
| JP | 2004040597 | A | 2/2004 |

* cited by examiner

ANTENNA MODULE

BACKGROUND OF THE INVENTION

Field of the Invention

The present invention relates to an antenna module and, more particularly, to an antenna module in which an antenna layer including a radiation conductor and a circuit layer including a filter circuit are integrated.

Description of Related Art

As the antenna module in which an antenna layer including a radiation conductor and a circuit layer including a filter circuit are integrated, the antenna module described in JP 2004-040597 A is known. In the antenna module described in JP 2004-040597 A, the antenna layer and the circuit layer are staked one over the other with a ground pattern interposed therebetween, thereby preventing mutual interference between the antenna layer and the circuit layer.

However, a planar size that the antenna layer requires and a planar size that the circuit layer requires do not necessarily coincide with each other, so that when the antenna layer and the circuit layer are stacked one over the other, a dead space may be disadvantageously generated in one of the antenna and circuit layers. For example, if a planar size that the circuit layer requires is smaller than a planar size that the antenna layer requires, a dead space is generated in the circuit layer, degrading the use efficiency of the circuit layer.

SUMMARY

It is therefore an object of the present invention to improve the use efficiency of the circuit layer in an antenna module in which the antenna layer and the circuit layer are stacked one over the other.

An antenna module according to the present invention includes: a circuit layer having a filter circuit; an antenna layer stacked on the circuit layer and having a radiation conductor; a feed layer positioned between the circuit layer and the antenna layer and having a first feed pattern connected to the filter circuit and electromagnetically coupled to the radiation conductor; a first ground pattern provided between the antenna layer and the feed layer; and a second ground pattern provided between the circuit layer and the feed layer. The first and second ground patterns have respective first and second slots at least partially overlapping each other as viewed in the stacking direction. The first feed pattern at least partially overlaps the radiation conductor and the first and second slots.

According to the present invention, the first feed pattern and the radiation conductor are electromagnetically coupled to each other through the first slot, thus eliminating the need to provide a power feeding line in the antenna layer. This can simplify the configuration of the antenna layer. Further, electromagnetic waves radiated from the first feed pattern enter the circuit layer through the second slot; however, by assigning a dead space of the circuit layer to the electromagnetic wave entering region, the use efficiency of the circuit layer can be improved.

In the present invention, the circuit layer may include a plurality of circuit block regions each in which elements constituting the filter circuit are disposed and a clearance region positioned between the plurality of circuit block regions as viewed in the stacking direction. The first and second slots may be disposed at positions overlapping the clearance region as viewed in the stacking direction. This allows the clearance region to be effectively used.

The antenna module according to the present invention may further include a first coupler pattern electromagnetically coupled to the first feed pattern. This allows power output from the first feed pattern to be monitored.

In the present invention, the first and second ground patterns may have respective third and fourth slots at least partially overlapping each other in the stacking direction. This, for example, allows another antenna signal to be fed through the third or fourth slot and allows the power of a signal radiated from the radiation conductor to be monitored.

In the present invention, the feed layer may further have a second feed pattern connected to the filter circuit and electromagnetically coupled to the radiation conductor, and the second feed pattern may at least partially overlap the radiation conductor and the third and fourth slots. With this configuration, the second feed pattern and the radiation conductor are electromagnetically coupled to each other through the third slot, allowing another antenna signal to be fed.

In the present invention, the first and second slots may overlap a first side edge of the radiation conductor as viewed in the stacking direction, and the third and fourth slots may overlap a second side edge of the radiation conductor that is opposite to the first side edge as viewed in the stacking direction. This, for example, allows differential signals to be fed to the radiation conductor using the first and second feed patterns.

In the present invention, the first and second slots may overlap the first side edge of the radiation conductor as viewed in the stacking direction, and the third and fourth slots may overlap a third side edge of the radiation conductor that is adjacent to the first side edge as viewed in the stacking direction. This, for example, allows a horizontally polarized signal to be fed to the radiation conductor by using the first feed pattern and allows a vertically polarized signal to be fed to the radiation conductor by using the second feed pattern.

In the present invention, the first and second ground patterns may have respective fifth and sixth slots at least partially overlapping each other as viewed in the stacking direction and respective seventh and eighth slots at least partially overlapping each other as viewed in the stacking direction. The fifth and sixth slots may overlap a second side edge of the radiation conductor that is opposite to the first side edge as viewed in the stacking direction, and the seventh and eighth slots may overlap a fourth side edge of the radiation conductor that is opposite to the third side edge as viewed in the stacking direction. This, for example, allows the fifth to eighth slots to function as dummy slots, thereby enhancing the symmetry of the radiation conductor.

In the present invention, the first and second slots may overlap the first side edge of the radiation conductor as viewed in the stacking direction, and the third and fourth slots may wholly overlap the radiation conductor as viewed in the stacking direction and extend in a direction perpendicular to the extending direction of the first and second slots. This allows isolation characteristics to be improved.

The antenna module according to the present invention may further include a second coupler pattern electromagnetically coupled to the radiation conductor through at least the third slot. This allows power radiated from the radiation conductor through the second coupler pattern to be monitored.

In the present invention, the filter circuit may include a band-pass filter. This allows passing of only an antenna signal in a specific bandwidth.

In the present invention, the antenna layer may have another radiation conductor overlapping the above-described radiation conductor as viewed in the stacking direction. This allows an antenna bandwidth to be extended.

The antenna module according to the present invention may have a configuration in which a plurality of radiation conductors are laid out in an array. This allows a so-called phased array structure to be constructed.

As described above, according to the present invention, the use efficiency of the circuit layer can be improved in an antenna module in which the antenna layer and the circuit layer are stacked one over the other.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

First Embodiment

Figure 1:
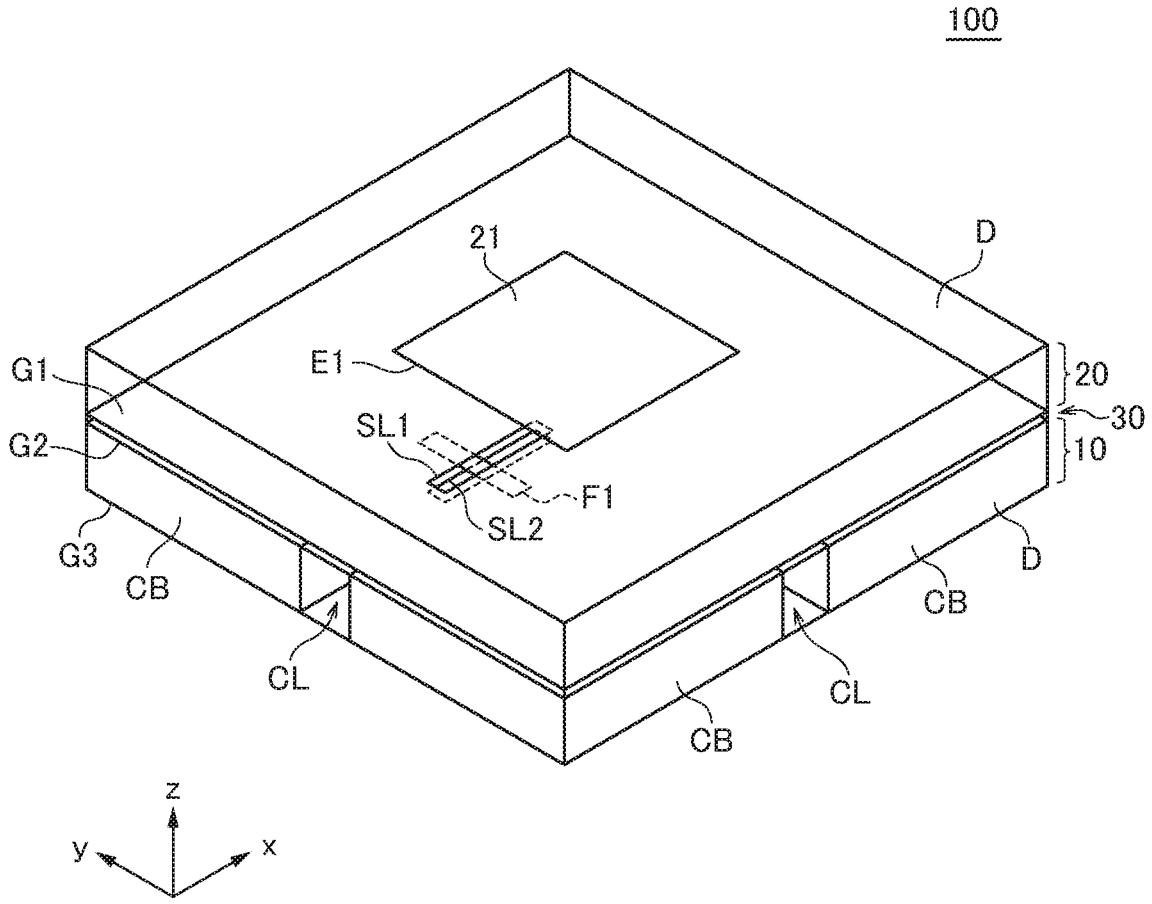
FIG. 1 is a transparent perspective view schematically illustrating an antenna module according to a first embodiment of the present invention.
Figure 2:
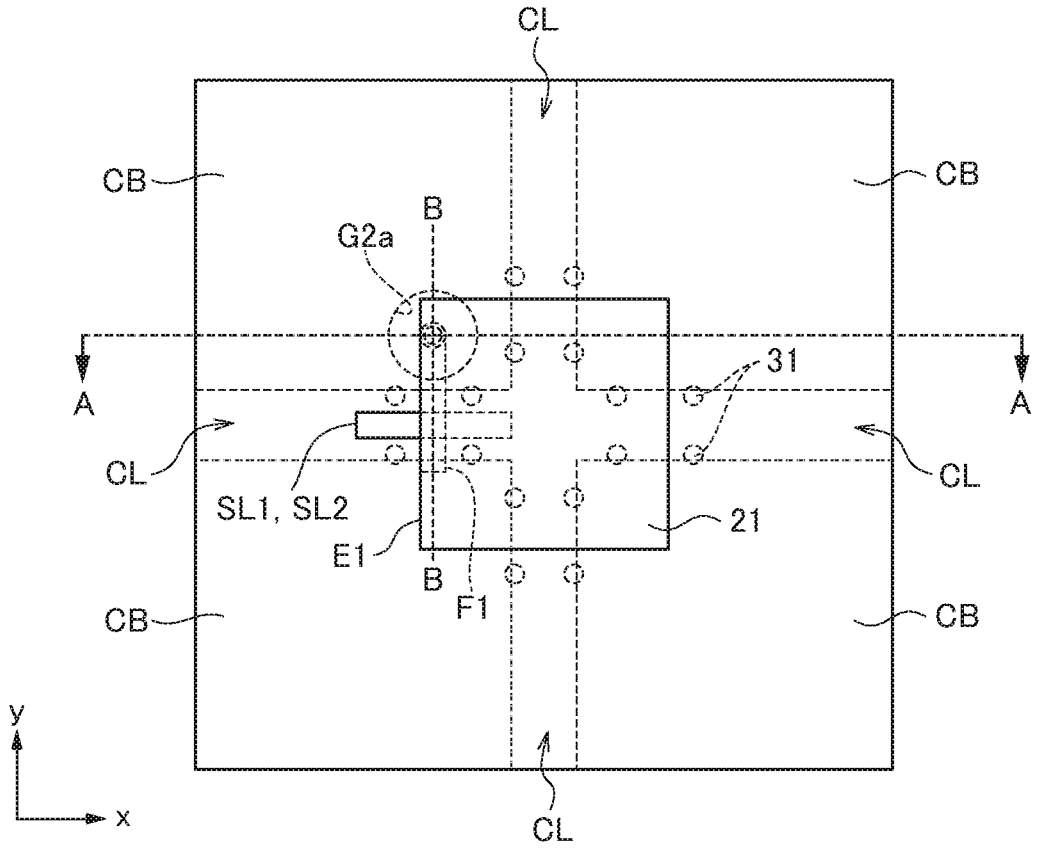
FIG. 2 is a transparent plan view schematically illustrating the antenna module according to the first embodiment of the present invention.
Figure 3:
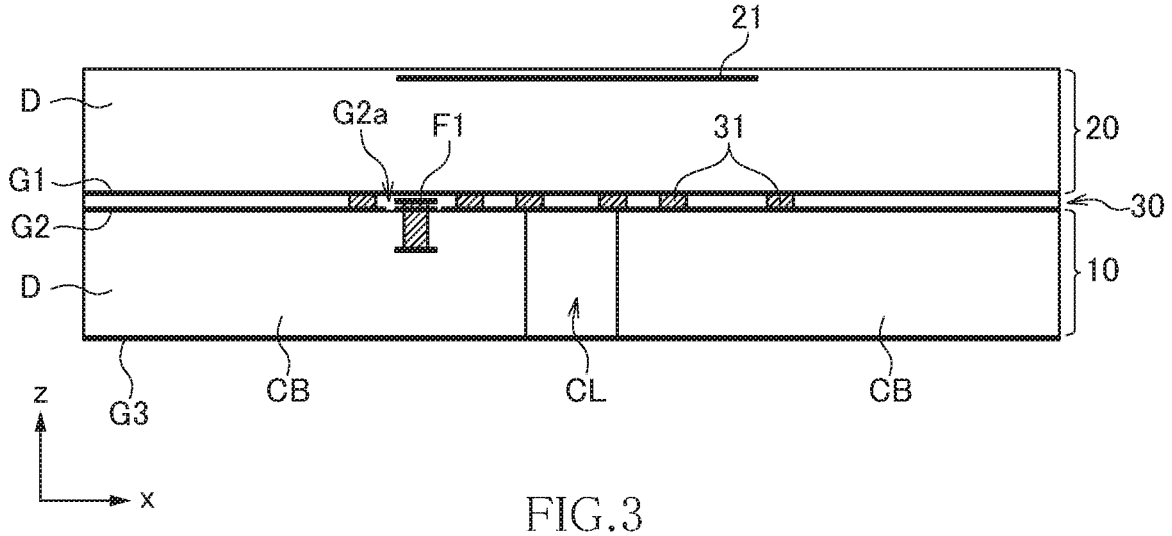
FIG. 3 is a schematic cross-sectional view of the antenna module taken along line A-A of FIG. 2.
Figure 4:
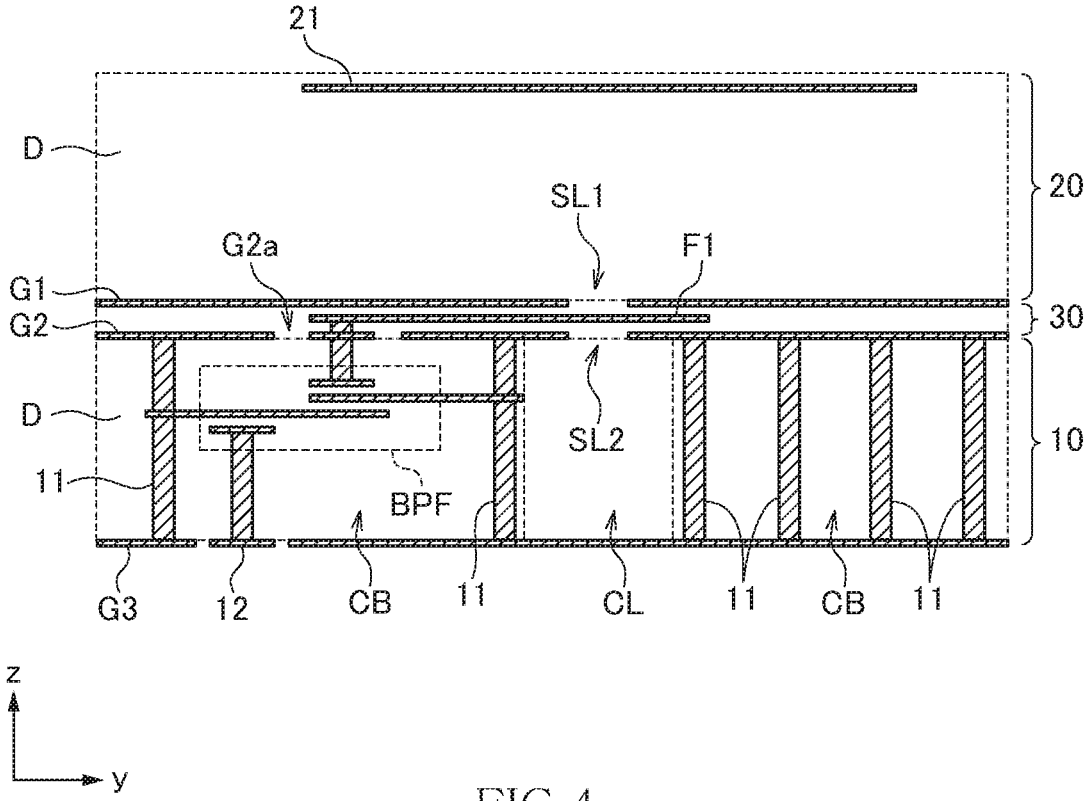
FIG. 4 is a schematic cross-sectional view of an end face taken along line B-B of FIG. 2.

FIG. 1 is a transparent perspective view schematically illustrating an antenna module 100 according to the first embodiment of the present invention. FIG. 2 is a transparent plan view schematically illustrating the antenna module 100, FIG. 3 is a schematic cross-sectional view of the antenna module 100 taken along line A-A of FIG. 2, and FIG. 4 is a schematic cross-sectional view of an end face taken along line B-B of FIG. 2.

The antenna module 100 according to the present embodiment is a module that performs wireless communication using a millimeter wave band and, as illustrated in FIGS. 1 to 4, has a circuit layer 10 as a lower layer, an antenna layer 20 as an upper layer, and a feed layer 30 positioned between the circuit layer 10 and the antenna layer 20. The circuit layer 10, antenna layer 20, and feed layer 30 each have a configuration in which various conductor patterns are formed on the inside of or on the surface of a dielectric layer D. Although not particularly limited, a ceramic material such as LTCC or a resin material can be used as the material of the dielectric layer D. In the present embodiment, a radiation conductor 21 included in the antenna layer 20 and a feed pattern F1 included in the feed layer 30 are electromagnetically coupled to each other, so that the circuit layer 10 and the antenna layer 20 can be made of different materials. For example, one of the circuit layer 10 and antenna layer 20 may be made of LTCC, and the other one thereof may be made of resin.

The circuit layer 10 is a layer in which a filter circuit such as a band-pass filter BPF is formed. The upper surface of the circuit layer 10 is covered with a ground pattern G2, and the lower surface thereof is covered with a ground pattern G3. The ground patterns G2 and G3 are short-circuited to each other by a large number of pillar conductors 11 extending in the z-direction (stacking direction), whereby a ground potential is stabilized. The ground pattern G2 is formed over substantially the entire xy plane excluding some portions such as an opening part G2*a* and a slot SL2 which are to be described later, whereby it functions as a shield against electromagnetic waves above the circuit layer 10. The ground pattern G3 is formed over substantially the entire xy plane excluding portions such as the formation position of an external terminal 12, whereby it functions as a shield against electromagnetic waves below the circuit layer 10.

The circuit layer 10 includes a plurality of circuit block regions CB in each of which elements constituting the filter circuit such as the band-pass filter BPF are disposed and a clearance region CL positioned between the plurality of circuit block regions CB as viewed in the z-direction. The clearance region CL is a region including no element constituting the filter circuit or a region where the formation density of the elements is lower than that of the circuit block region CB. The reason that the thus configured clearance region CL exists is that a planar size that the antenna layer 20 requires is larger than a planar size that the circuit layer 10 requires. The periphery of the circuit block region CB is surrounded by the plurality of pillar conductors 11, whereby the clearance region CL is shielded from the circuit block region CB. In the present embodiment, the clearance region CL is laid out in a cross-like pattern so as to pass the center point of the antenna module 100 as viewed in the z-direction, whereby symmetry is ensured.

The antenna layer 20 is a layer having the radiation conductor 21. The radiation conductor 21 is a rectangular conductor pattern disposed at substantially the center of the antenna module 100 as viewed in the stacking direction (in a plan view (as viewed in the z-direction)). The radiation conductor 21 is not connected to other conductor patterns and is in a DC floating state. The upper surface of the antenna layer 20 is opened, while the lower surface thereof is covered with a ground pattern G1. The ground pattern G1 is formed over substantially the xy plane excluding portions such as a slot SL1 to be described later, whereby it functions as a reference conductor for a patch antenna. The ground patterns G1 and G2 are short-circuited to each other by a large number of pillar conductors 31 extending in the z-direction (stacking direction), whereby a ground potential is stabilized.

The feed layer 30 is positioned between the circuit layer 10 and the antenna layer 20. The ground pattern G2 exists between the feed layer 30 and the circuit layer 10, and the ground pattern G1 exists between the feed layer 30 and the antenna layer 20. A feed pattern F1 is provided in the feed layer 30. The feed pattern F1 is a band-like conductor extending in the y-direction. In the present embodiment, the entire feed pattern F1 overlaps the radiation conductor 21. One end of the feed pattern F1 is connected to the band-pass filter BPF of the circuit layer through the opening part G2*a* formed in the ground pattern G2.

A part of the feed pattern F1 near the leading end thereof overlaps the slot SL1 formed in the ground pattern G1 and the slot SL2 formed in the ground pattern G2 as viewed in the z-direction. The slots SL1 and SL2 are cut portions formed in the ground patterns G1 and G2, respectively, and each have a shape elongated in the x-direction in the present embodiment. The slots SL1 and SL2 overlap each other as viewed in the z-direction and are disposed so as to cross a side edge E1 of the radiation conductor 21 extending in the y-direction.

The feed pattern F1 is electromagnetically coupled to the radiation conductor 21 through the slot SL1. As a result, an antenna signal fed from the band-pass filter BPF to the feed pattern F1 is fed to the radiation conductor 21 through the slot SL1 to be radiated to a space. As described above, in the present embodiment, power is not directly fed to the radiation conductor 21 using the pillar-shaped conductor, but is fed by electromagnetic coupling through the slot SL1. This significantly simplifies the configuration of the antenna layer 20, which in turn can simplify a manufacturing process.

Electromagnetic waves radiated from the feed pattern F1 are also radiated to the circuit layer 10 through the slot SL2. The clearance region CL is assigned to a position overlapping the slot SL2, so that mutual interface between the filter circuit included in the circuit layer 10 and the feed pattern F1 is prevented. The slot SL2 is an element required for the feed pattern F1 and the radiation conductor 21 to be sufficiently electromagnetically coupled to each other through the slot SL1. When the slot SL2 does not exist at a position overlapping the slot SL1, electromagnetic coupling between the feed pattern F1 and the radiation conductor 21 becomes insufficient.

As described above, in the antenna module 100 according to the present embodiment, power feeding is achieved by electromagnetic coupling through the slot SL1, so that the configuration of the antenna layer 20 can be simplified. In addition, the clearance region CL is assigned to a part of the circuit layer 10 that overlaps the slots SL1 and SL2, so that it is possible to prevent mutual interference between the feed pattern F1 and the filter circuit while improving the use efficiency of the circuit layer 10.

Further, in the present embodiment, the circuit block region CB is divided into four blocks, and the clearance region CL is laid out in a cross-like pattern so as to pass the center point of the antenna module 100, whereby the symmetry of the radiation conductor 21 can be enhanced.

Figure 5:
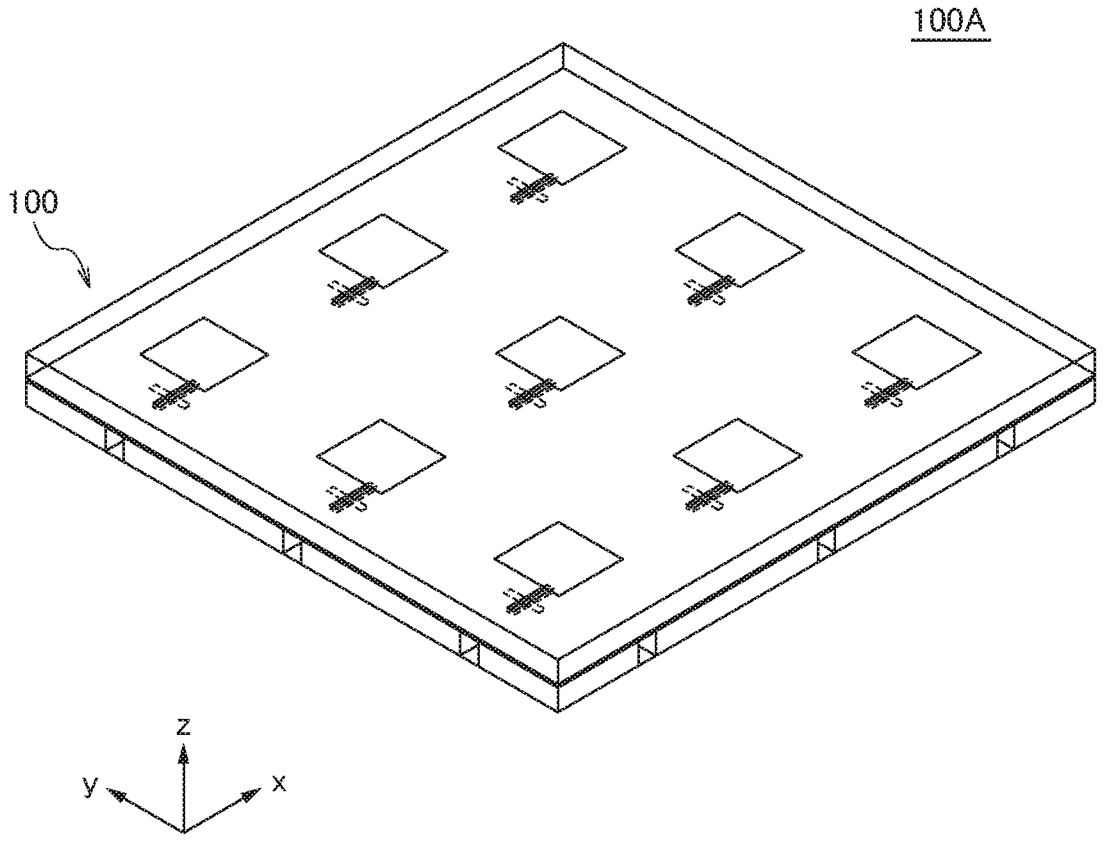
FIG. 5 is a schematic perspective view for explaining the configuration of an antenna module in which a plurality of antenna modules shown in FIG. 1 are laid out in an array.

FIG. 5 is a schematic perspective view for explaining the configuration of an antenna module 100A in which a plurality of antenna modules 100 are laid out in an array. In the example of FIG. 5, nine antenna modules 100 are laid out in an array in the xy plane. By thus laying out the plurality of antenna modules 100 in an array, a so-called phased array structure can be constructed. This allows the direction of a beam to be changed as desired.

Second Embodiment

Figure 6:
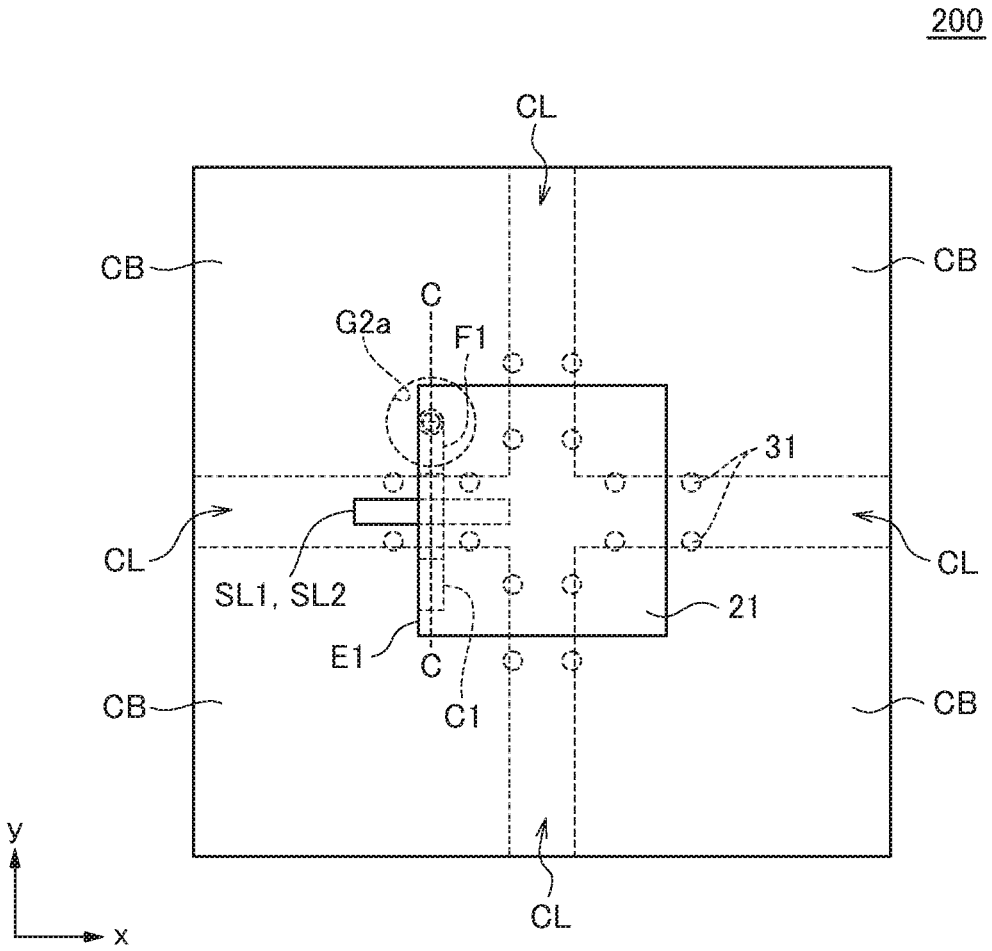
FIG. 6 is a transparent plan view schematically illustrating an antenna module according to a second embodiment of the present invention.
Figure 7:
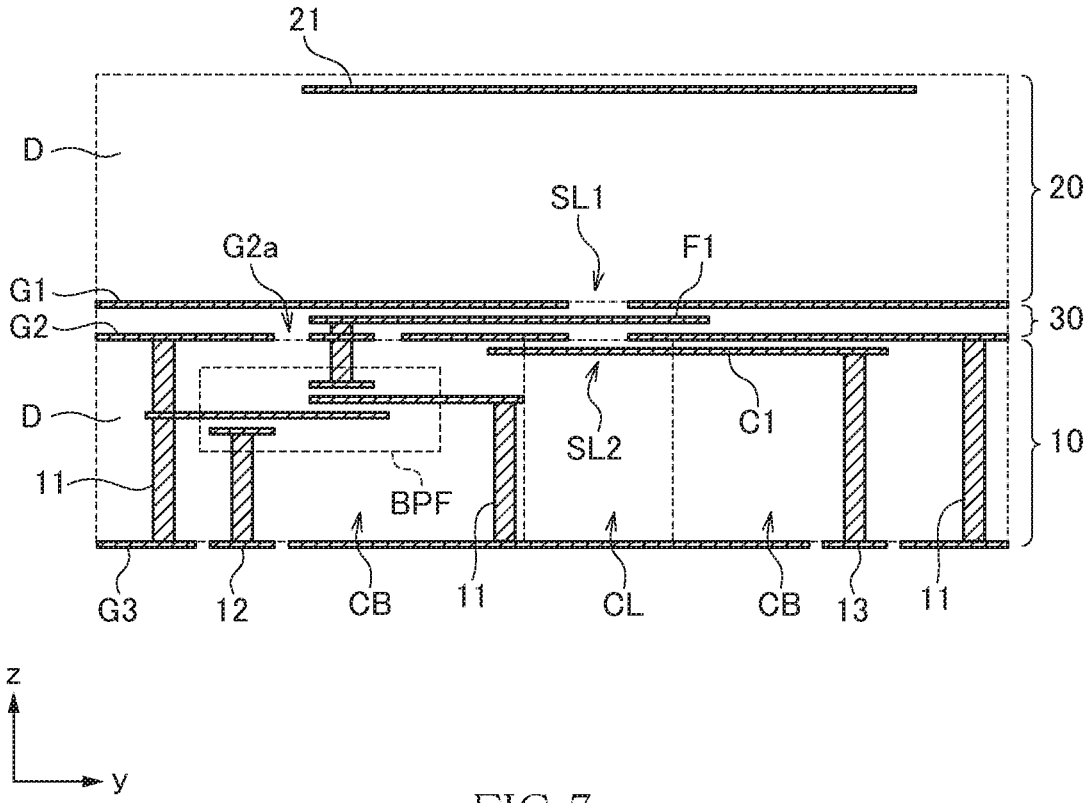
FIG. 7 is a schematic cross-sectional view of an end face taken along line C-C of FIG. 6.

FIG. 6 is a transparent plan view schematically illustrating an antenna module 200 according to the second embodiment of the present invention. FIG. 7 is a schematic cross-sectional view of an end face taken along line C-C of FIG. 6.

As illustrated in FIGS. 6 and 7, the antenna module 200 according to the second embodiment differs from the antenna module 100 according to the first embodiment in that the circuit layer 10 additionally includes a coupler pattern C1 and an external terminal 13 connected to the coupler pattern C1. Other configurations are basically the same as those of the antenna module 100 according to the first embodiment, so the same reference numerals are given to the same elements, and overlapping description will be omitted.

The coupler pattern C1 is a band-like conductor pattern extending in the y-direction and is disposed at a position overlapping the feed pattern F1 through the slot SL2. With this configuration, the feed pattern F1 and the coupler pattern C1 are electromagnetically coupled to each other through the slot SL2, so that a part of an antenna signal output from the feed pattern F1 is fed to the coupler pattern C1. Thus, when the external terminal 13 connected to the coupler pattern C1 is connected to an amplifier or the like to monitor power, the power of an antenna signal output from the feed pattern F1 can be detected.

As described above, the antenna module 200 according to the present embodiment has the coupler pattern C1 electromagnetically coupled to the feed pattern F1, so that the power of an antenna signal output from the feed pattern F1 can be detected. The degree of coupling between the feed pattern F1 and the coupler pattern C1 can be adjusted by the distance between the feed pattern F1 and the coupler pattern C1 in the z-direction, the planar size of the coupler pattern C1, or the like.

Third Embodiment

Figure 8:
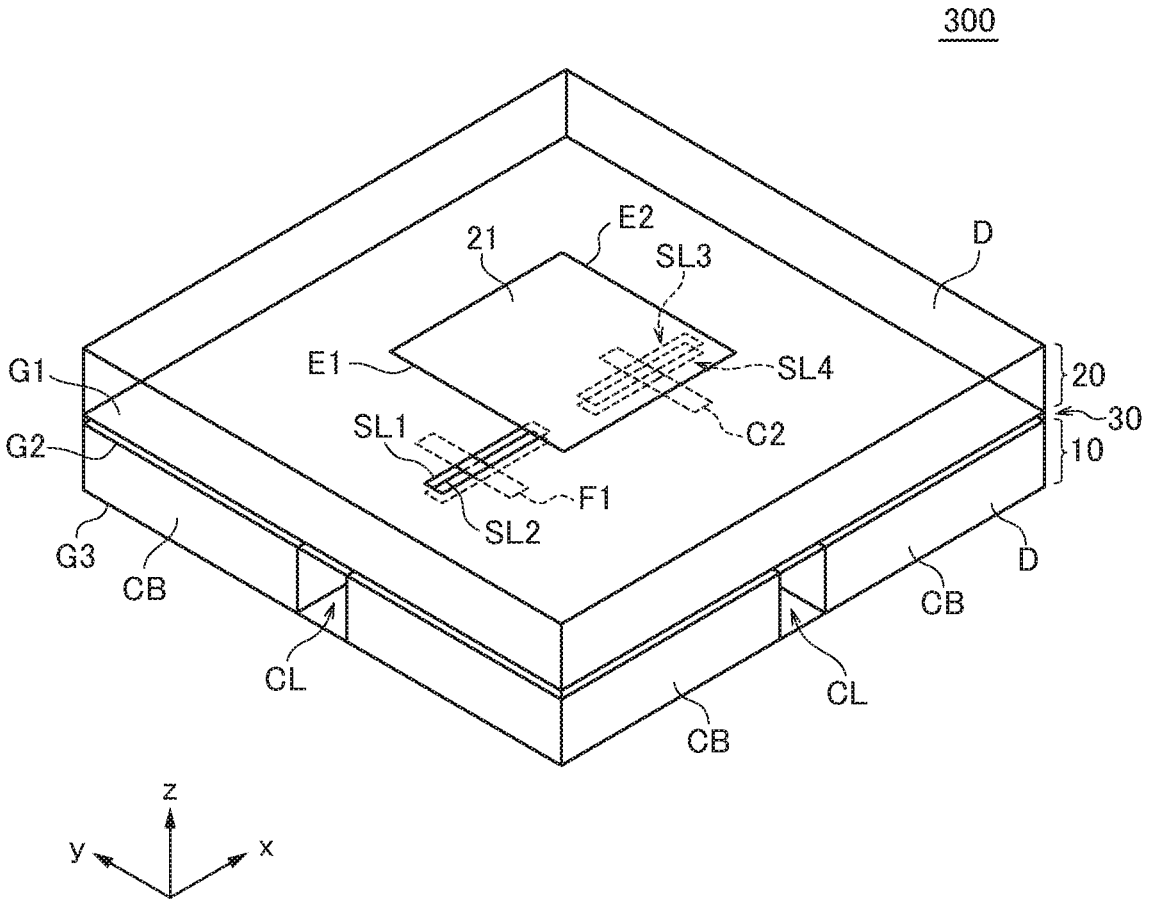
FIG. 8 is a transparent perspective view schematically illustrating an antenna module according to a third embodiment of the present invention.
Figure 9:
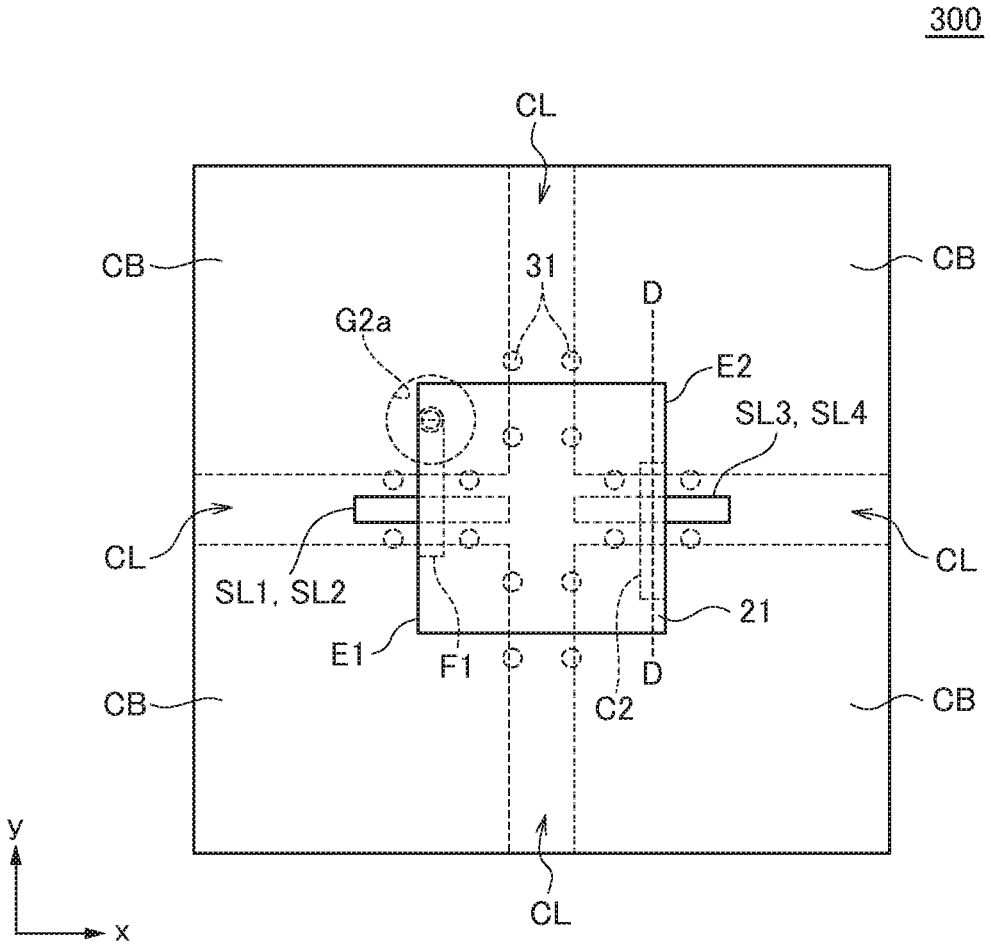
FIG. 9 is a transparent plan view schematically illustrating the antenna module shown in FIG. 8.

FIG. 8 is a transparent perspective view schematically illustrating an antenna module 300 according to the third embodiment of the present invention. FIG. 9 is a transparent plan view schematically illustrating the antenna module 300, and FIG. 10 is a schematic cross-sectional view of an end face taken along line D-D of FIG. 9.

Figure 10:
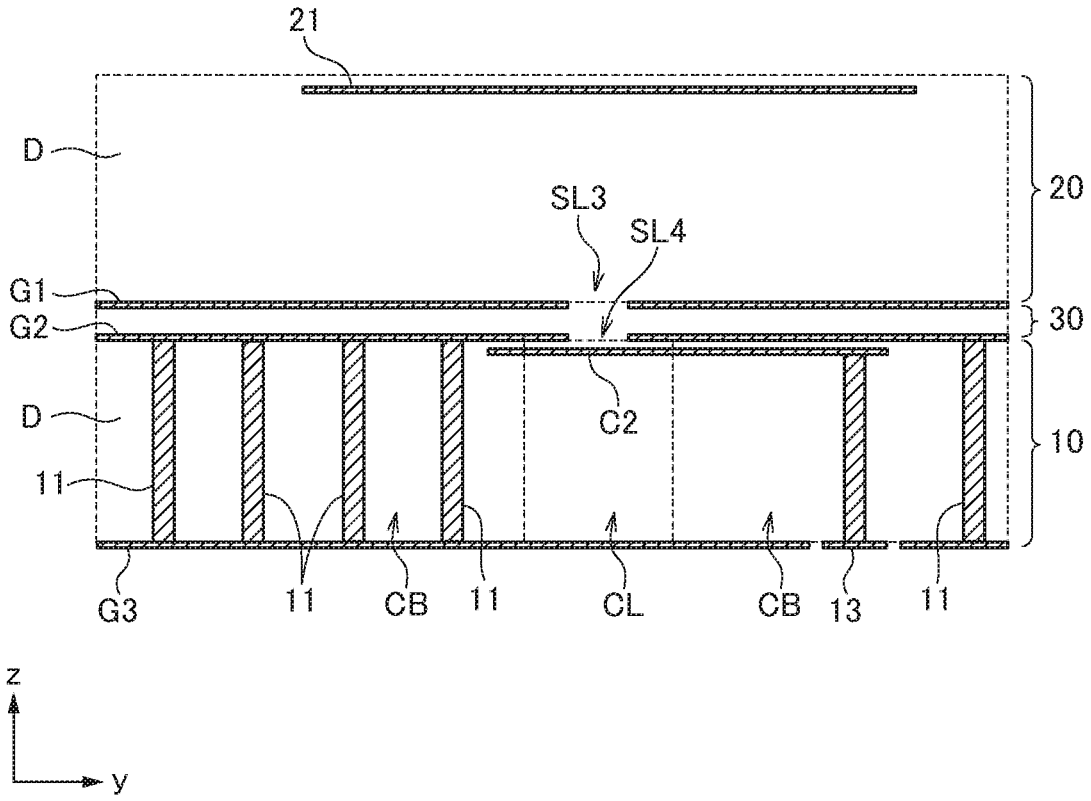
FIG. 10 is a schematic cross-sectional view of an end face taken along line D-D of FIG. 9.

As illustrated in FIGS. 8 to 10, the antenna module 300 according to the third embodiment differs from the antenna module 100 according to the first embodiment in that slots SL3 and SL4 are additionally formed in the ground patterns G1 and G2, respectively, and that a coupler pattern C2 is provided at a position overlapping the slots SL3 and SL4. Other configurations are basically the same as those of the antenna module 100 according to the first embodiment, so the same reference numerals are given to the same elements, and overlapping description will be omitted.

The slots SL3 and SL4 each have a shape elongated in the x-direction. The slots SL3 and SL4 overlap each other as viewed in the z-direction and are disposed so as to cross a side edge E2 of the radiation conductor 21 extending in the y-direction. The side edge E2 is opposite to the side edge E1.

The coupler pattern C2 is a band-like conductor pattern provided in the circuit layer 10 and extending in the y-direction and is disposed at a position overlapping the radiation conductor 21 through the slots SL3 and SL4. With this configuration, the radiation conductor 21 and the coupler pattern C2 are electromagnetically coupled to each other through the slots SL3 and SL4, so that a part of radiation energy of the radiation conductor 21 is fed to the coupler pattern C2. Thus, when the external terminal 13 connected to the coupler pattern C2 is connected to an amplifier or the like to monitor power, the power of an antenna signal output from the radiation conductor 21 can be detected.

As described above, the antenna module 300 according to the present embodiment has the coupler pattern C2 electromagnetically coupled to the radiation conductor 21, so that the power of an antenna signal output from the radiation conductor 21 can be detected. In the present embodiment, the coupler pattern C2 may be disposed between the ground patterns G1 and G2, i.e., in the feed layer 30; however, in this case, the coupling between the radiation conductor 21 and coupler pattern C2 may become too strong, deteriorating antenna efficiency. Therefore, it is more preferable to dispose the coupler pattern C2 in the circuit layer 10 than in the feed layer 30. The degree of coupling between the radiation conductor 21 and the coupler pattern C2 can be adjusted by the distance between the radiation conductor 21 and the coupler pattern C2 in the z-direction, the planar size of the coupler pattern C2, the size of the slots SL3 and SL4, or the like.

In place of, or in addition to the coupler pattern C2, another feed pattern may be provided in the feed layer 30 so as to overlap the slots SL3 and SL4. In this case, when complementary differential antenna signals are fed to the feed pattern F1 overlapping the slots SL1 and SL2 and another feed pattern overlapping the SL3 and SL4, it becomes unnecessary to convert differential antenna signals into a single-ended antenna signal using a balun transformer, etc.

Fourth Embodiment

Figure 11:
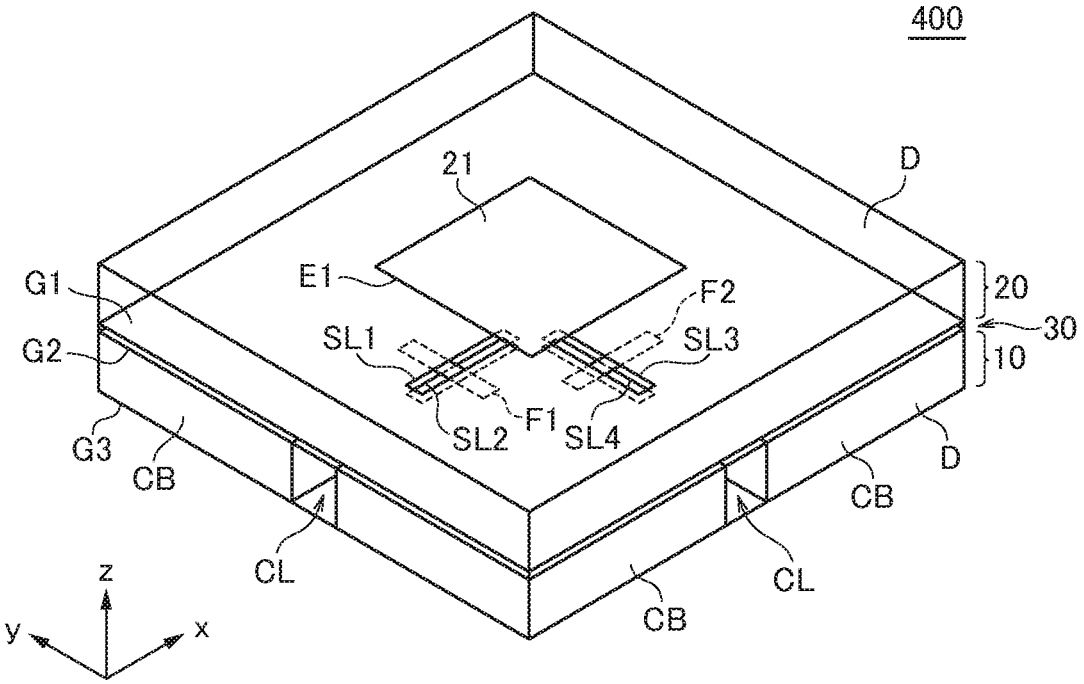
FIG. 11 is a transparent perspective view schematically illustrating an antenna module according to a fourth embodiment of the present invention.
Figure 12:
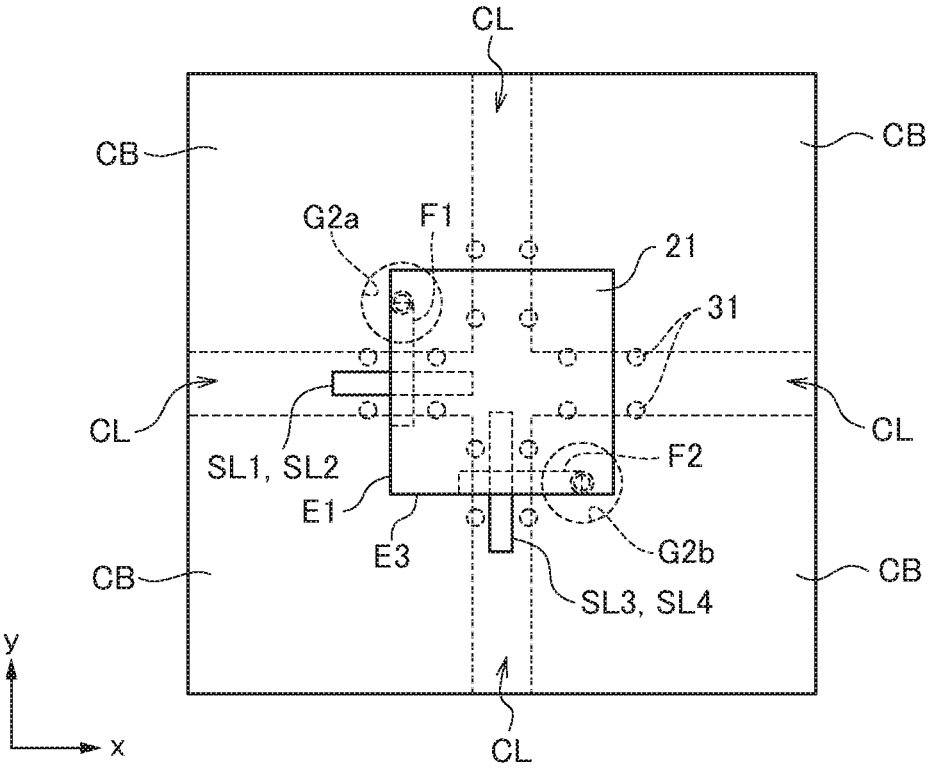
FIG. 12 is a transparent plan view schematically illustrating the antenna module shown in FIG. 11.

FIG. 11 is a transparent perspective view schematically illustrating an antenna module 400 according to the fourth embodiment of the present invention. FIG. 12 is a transparent plan view schematically illustrating the antenna module 400.

As illustrated in FIGS. 11 and 12, the antenna module 400 according to the fourth embodiment differs from the antenna module 100 according to the first embodiment in that slots SL3 and SL4 are additionally formed in the ground patterns G1 and G2, respectively, and that a feed pattern F2 is provided at a position overlapping the slots SL3 and SL4. Other configurations are basically the same as those of the antenna module 100 according to the first embodiment, so the same reference numerals are given to the same elements, and overlapping description will be omitted.

The slots SL3 and SL4 each have a shape elongated in the y-direction. The slots SL3 and SL4 overlap each other as viewed in the z-direction and are disposed so as to cross a side edge E3 of the radiation conductor 21 extending in the x-direction. The side edge E3 is adjacent to the side edge E1.

The feed pattern F2 is a band-like conductor pattern provided in the feed layer 30 and extending in the x-direction. In the present embodiment, the entire feed pattern F2 overlaps the radiation conductor 21. One end of the feed pattern F2 is connected to the band-pass filter BPF of the circuit layer 10 through an opening Gb2 formed in the ground pattern G2.

A part of the feed pattern F2 near the leading end thereof overlaps the slot SL3 formed in the ground pattern G1 and the slot SL4 formed in the ground pattern G2 as viewed in the z-direction.

As described above, the antenna module 400 according to the present embodiment has the two feed patterns F1 and F2 electromagnetically coupled to the radiation conductor 21, and the two feed patterns F1 and F2 are disposed along the mutually perpendicular side edges E1 and E3 of the radiation conductor 21, so that the antenna module 400 functions as a dual polarization wave antenna. For example, it is possible to feed a horizontally polarized signal to the radiation conductor 21 by using the feed pattern F1 and to feed a vertically polarized signal to the radiation conductor 21 by using the feed pattern F2. In addition, the configurations of the feed patterns F1 and F2 are the same except that the feeding positions thereof differ by 90° from each other, so that the horizontally polarized signal and vertically polarized signal can be easily balanced.

Fifth Embodiment

Figure 13:
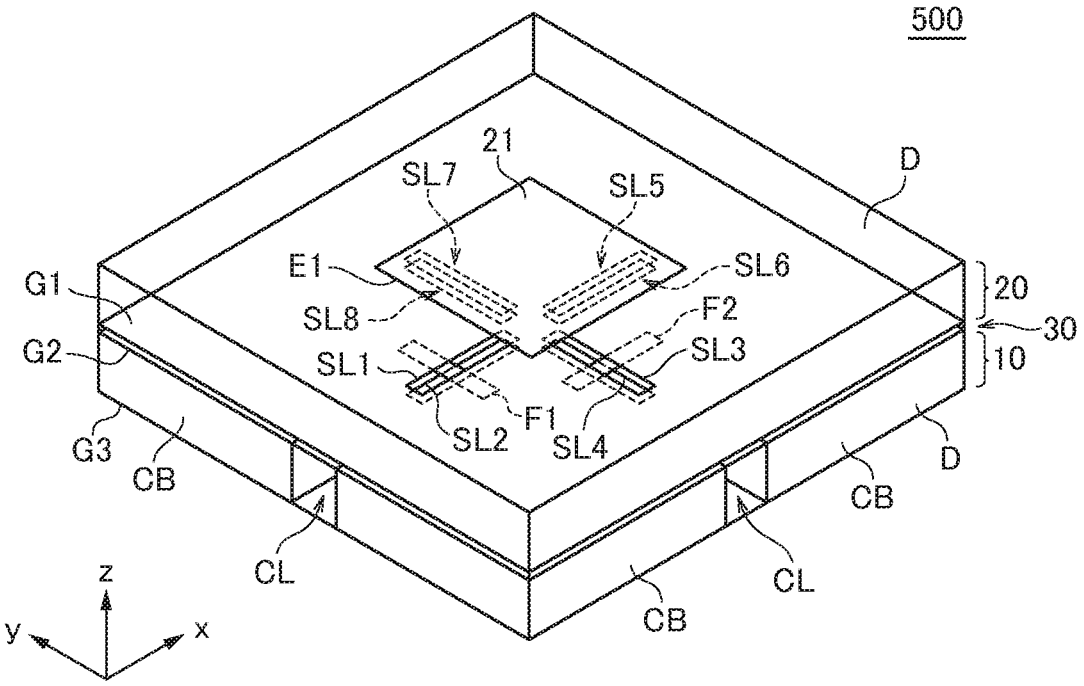
FIG. 13 is a transparent perspective view schematically illustrating an antenna module according to a fifth embodiment of the present invention.
Figure 14:
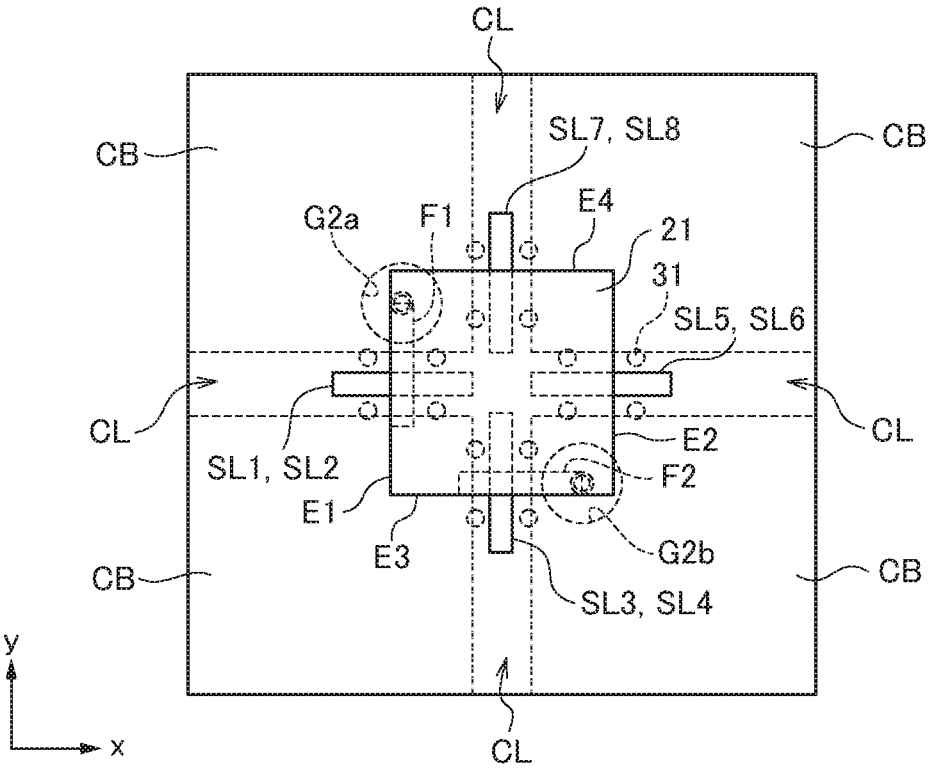
FIG. 14 is a transparent plan view schematically illustrating the antenna module shown in FIG. 13.

FIG. 13 is a transparent perspective view schematically illustrating an antenna module 500 according to the fifth embodiment of the present invention. FIG. 14 is a transparent plan view schematically illustrating the antenna module 500.

As illustrated in FIGS. 13 and 14, the antenna module 500 according to the fifth embodiment differs from the antenna module 400 according to the fourth embodiment in that slots SL5 and SL7 are additionally formed in the ground pattern G1 and that slots SL6 and SL8 are additionally formed in the ground pattern G2. Other configurations are basically the same as those of the antenna module 400 according to the fourth embodiment, so the same reference numerals are given to the same elements, and overlapping description will be omitted.

The slots SL5 and SL6 each have a shape elongated in the x-direction. The slots SL5 and SL6 overlap each other as viewed in the z-direction and are disposed so as to cross the side edge E2 of the radiation conductor 21 extending in the y-direction. The slots SL7 and SL8 each have a shape elongated in the y-direction. The slots SL7 and SL8 overlap each other as viewed in the z-direction and are disposed so as to cross a side edge E4 of the radiation conductor 21 extending in the x-direction. The side edge E4 is opposite to the side edge E3 and adjacent to the side edges E1 and E2.

The slots SL5 to SL8 are dummy slots and are provided for enhancing the symmetry of the radiation conductor 21. That is, the dummy slots SL5 and SL6 are disposed at positions symmetrical to the slots SL1 and SL2, respectively, to play a role of enhancing the symmetry of the radiation conductor 21 in the x-direction. Similarly, the dummy slots SL7 and SL8 are disposed at positions symmetrical to the slots SL3 and SL4, respectively, to play a role of enhancing the symmetry of the radiation conductor 21 in the y-direction.

As described above, the antenna module 500 according to the present embodiment has the dummy slots for enhancing the symmetry of the radiation conductor 21, thus making it possible to obtain more satisfactory antenna characteristics.

Further, it is possible to detect the power of the horizontally polarized signal and the power of the vertically polarized signal by providing a coupler pattern in the circuit layer 10 or feed layer 30 so as to overlap the slots SL5 and SL6 and by providing another coupler pattern in the circuit layer 10 or feed layer 30 so as to overlap the slots SL7 and SL8. Further, it is possible to make each of the horizontally polarized signal and vertically polarized signal into a differential form by providing another feed pattern in the feed layer 30 so as to overlap the slots SL5 and SL6 and by providing still another feed pattern in the feed layer 30 so as to overlap the slots SL7 and SL8.

Sixth Embodiment

Figure 15:
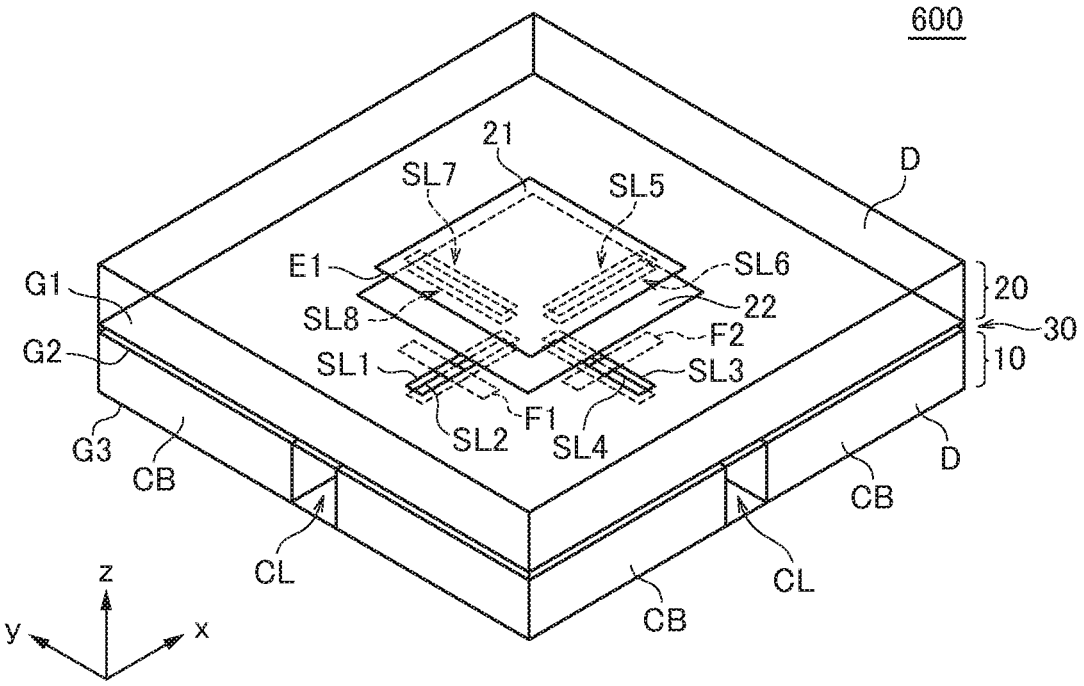
FIG. 15 is a transparent perspective view schematically illustrating an antenna module according to a sixth embodiment of the present invention.
Figure 16:
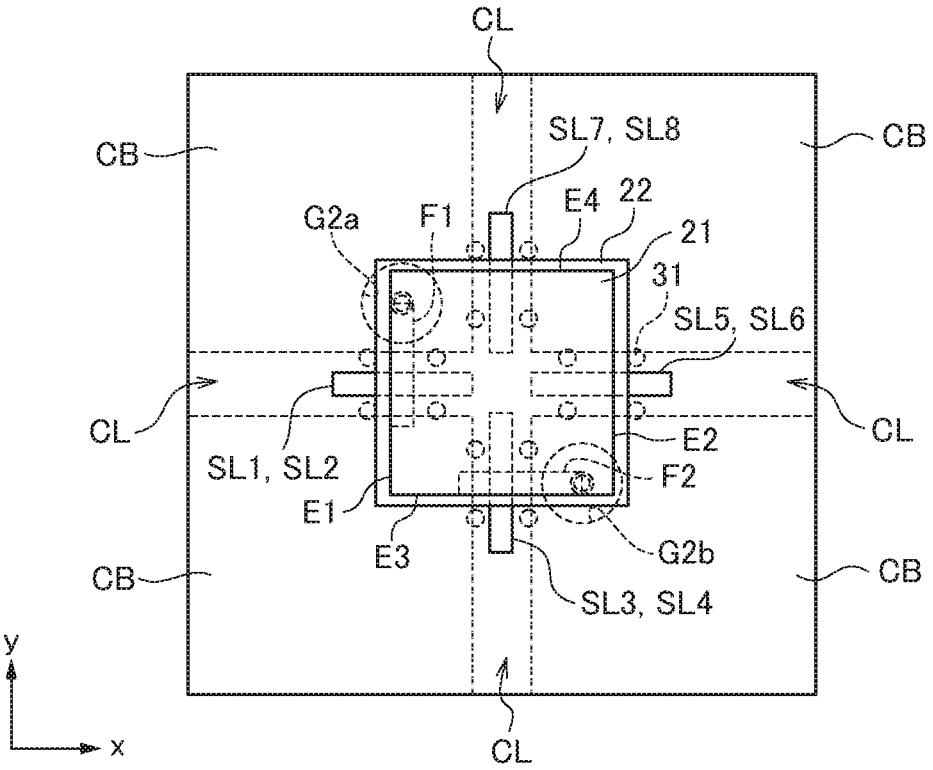
FIG. 16 is a transparent plan view schematically illustrating the antenna module shown in FIG. 15.

FIG. 15 is a transparent perspective view schematically illustrating an antenna module 600 according to the sixth embodiment of the present invention. FIG. 16 is a transparent plan view schematically illustrating the antenna module 600.

As illustrated in FIGS. 15 and 16, the antenna module 600 according to the sixth embodiment differs from the antenna module 500 according to the fifth embodiment in that a radiation conductor 22 is additionally provided in the antenna layer 20. Other configurations are basically the same as those of the antenna module 500 according to the fifth embodiment, so the same reference numerals are given to the same elements, and overlapping description will be omitted.

The radiation conductor 22 is a rectangular conductor pattern disposed below the radiation conductor 21 so as to overlap the radiation conductor 21. The radiation conductor 22 is not connected to other conductor patterns and is in a DC floating state. By thus forming the plurality of radiation conductors 21 and 22 in the antenna layer 20, it is possible to extend an antenna bandwidth. While the size of the radiation conductor 22 is slightly larger than that of the radiation conductor 21 in the example illustrated in FIGS. 15 and 16, the sizes of the radiation conductors 21 and 22, the distance between the radiation conductors 21 and 22, and the like may be appropriately adjusted depending on required antenna characteristics.

Seventh Embodiment

Figure 17:
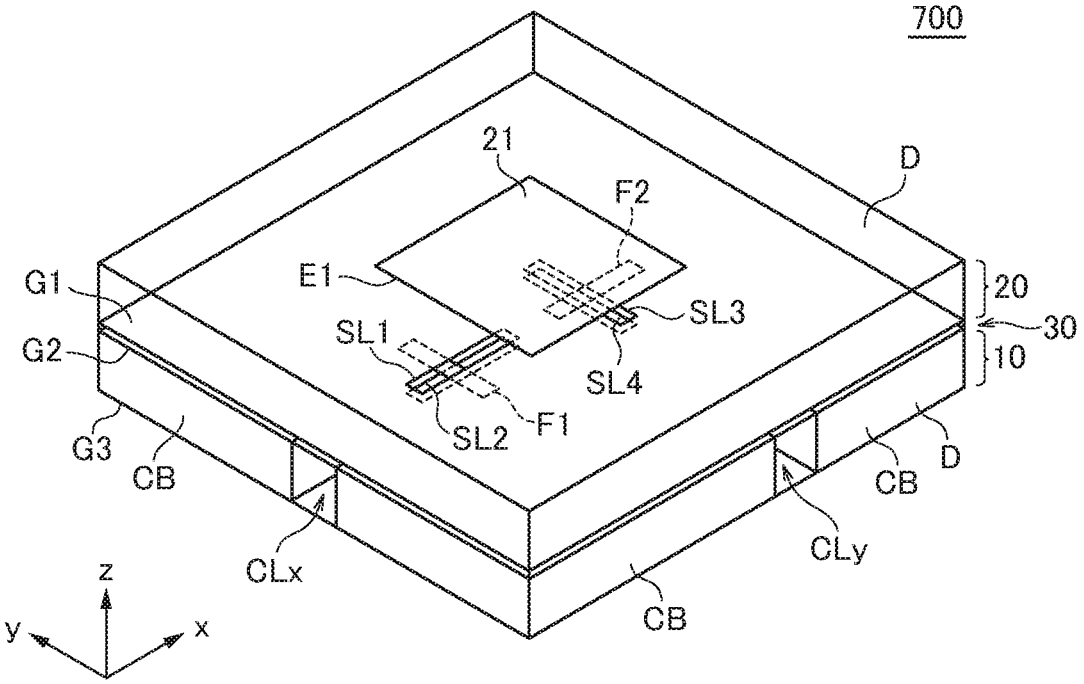
FIG. 17 is a transparent perspective view schematically illustrating an antenna module according to a seventh embodiment of the present invention.
Figure 18:
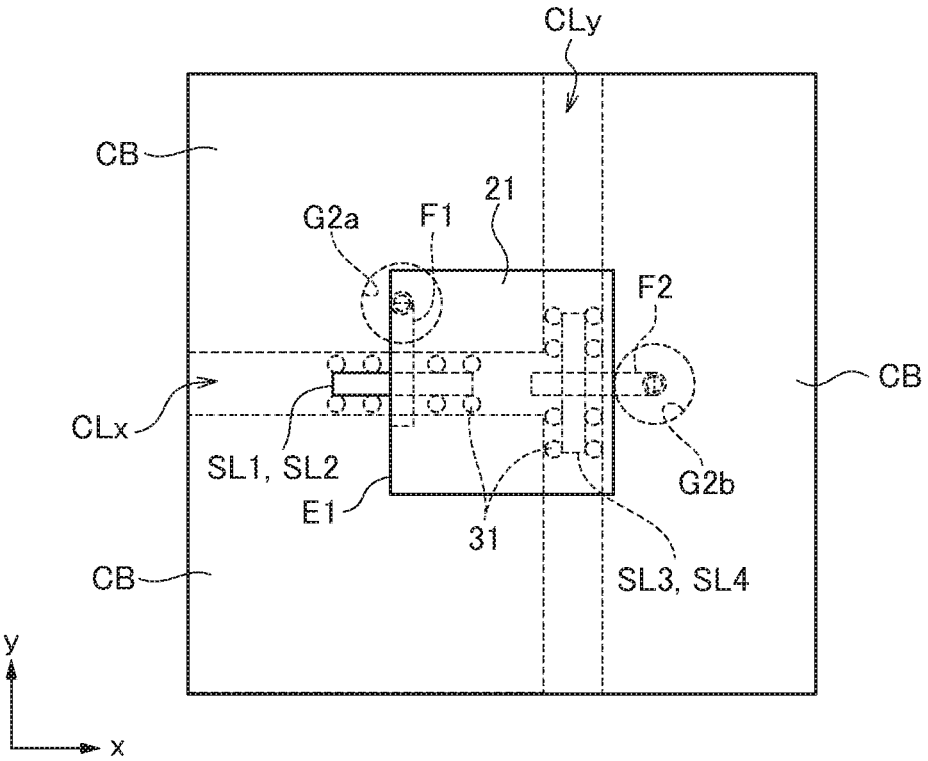
FIG. 18 is a transparent plan view schematically illustrating the antenna module shown in FIG. 17.

FIG. 17 is a transparent perspective view schematically illustrating an antenna module 700 according to the seventh embodiment of the present invention. FIG. 18 is a transparent plan view schematically illustrating the antenna module 700.

As illustrated in FIGS. 17 and 18, the antenna module 700 according to the seventh embodiment differs from the antenna modules 100 to 600 according to the first to sixth embodiments in the layout of the circuit block region CB and clearance region CL that constitute the circuit layer 10. Specifically, there are provided a clearance region CLx extending in the x-direction passing the center of the circuit layer 10 in the y-direction and a clearance region CLy extending in the y-direction passing a region offset from the center of the circuit layer 10 in the x-direction, and the clearance regions CLx and CLy form a T-shape in a plan view.

The slots SL1 and SL2 are disposed at positions overlapping the clearance region CLx, and the slots SL3 and SL4 are disposed at positions overlapping the clearance region CLy. Further, in the feed layer 30, the feed pattern F1 is disposed so as to cross the slots SL1 and SL2, and the feed pattern F2 is disposed so as to cross the slots SL3 and SL4. The slots SL1 and SL2 extend in the x-direction so as to overlap the side edge E1 of the radiation conductor 21 as in the first embodiment, while the slots SL3 and SL4 extend in the y-direction so as to wholly overlap the radiation conductor 21.

Thus, the antenna module 700 according to the present embodiment functions as a dual polarization wave antenna like the antenna module 400 according to the fourth embodiment. For example, it is possible to feed a horizontally polarized signal to the radiation conductor 21 by using the feed pattern F1 and to feed a vertically polarized signal to the radiation conductor 21 by using the feed pattern F2. The antenna module 700 according to the present embodiment can also obtain more satisfactory isolation characteristics than the antenna module 400.

It is apparent that the present invention is not limited to the above embodiments, but may be modified and changed without departing from the scope and spirit of the invention.

What is claimed is:

1. An antenna device comprising:

a circuit layer having a filter circuit;

an antenna layer stacked on the circuit layer and having a radiation conductor;

a feed layer positioned between the circuit layer and the antenna layer and having a first feed pattern connected to the filter circuit and electromagnetically coupled to the radiation conductor;

a first ground pattern provided between the antenna layer and the feed layer; and a second ground pattern provided between the circuit layer and the feed layer, wherein the first and second ground patterns have first and second slots, respectively, at least partially overlapping each other as viewed in a stacking direction, wherein the first feed pattern at least partially overlaps the radiation conductor and the first and second slots, wherein the circuit layer includes a plurality of circuit block regions, within each of which are disposed elements constituting the filter circuit, and a clearance region positioned between the plurality of circuit block regions as viewed in the stacking direction, and wherein the first and second slots are disposed at positions overlapping the clearance region as viewed in the stacking direction.

2. The antenna device as claimed in claim 1, further comprising a first coupler pattern electromagnetically coupled to the first feed pattern.

3. The antenna device as claimed in claim 1, wherein the filter circuit includes a band-pass filter.

4. The antenna device as claimed in claim 1, wherein the antenna layer has another radiation conductor overlapping the radiation conductor as viewed in the stacking direction.

5. The antenna device as claimed in claim 1, wherein a plurality of the radiation conductors are laid out in an array.

6. An antenna device comprising:

a circuit layer having a filter circuit;

an antenna layer stacked on the circuit layer and having a radiation conductor;

a feed layer positioned between the circuit layer and the antenna layer and having a first feed pattern connected to the filter circuit and electromagnetically coupled to the radiation conductor;

a first ground pattern provided between the antenna layer and the feed layer; and a second ground pattern provided between the circuit layer and the feed layer, wherein the first and second ground patterns have first and second slots, respectively, at least partially overlapping each other as viewed in a stacking direction, wherein the first feed pattern at least partially overlaps the radiation conductor and the first and second slots, and wherein the first and second ground patterns have third and fourth slots, respectively, at least partially overlapping each other in the stacking direction.

7. The antenna device as claimed in claim 6, wherein the feed layer further has a second feed pattern connected to the filter circuit and electromagnetically coupled to the radiation conductor, and wherein the second feed pattern at least partially overlap the radiation conductor and the third and fourth slots.

8. The antenna device as claimed in claim 6, wherein the first and second slots overlap a first side edge of the radiation conductor as viewed in the stacking direction, and wherein the third and fourth slots overlap a second side edge of the radiation conductor that is opposite to the first side edge as viewed in the stacking direction.

9. The antenna device as claimed in claim 6, wherein the first and second slots overlap a first side edge of the radiation conductor as viewed in the stacking direction, and wherein the third and fourth slots overlap a third side edge of the radiation conductor that is adjacent to the first side edge as viewed in the stacking direction.

10. The antenna device as claimed in claim 9, wherein the first and second ground patterns have fifth and sixth slots, respectively, at least partially overlapping each other as viewed in the stacking direction and seventh and eighth slots, respectively, at least partially overlapping each other as viewed in the stacking direction, wherein the fifth and sixth slots overlap a second side edge of the radiation conductor that is opposite to the first side edge as viewed in the stacking direction, and wherein the seventh and eighth slots overlap a fourth side edge of the radiation conductor that is opposite to the third side edge as viewed in the stacking direction.

11. The antenna device as claimed in claim 7, wherein the first and second slots overlap a first side edge of the radiation conductor as viewed in the stacking direction, and wherein the third and fourth slots wholly overlap the radiation conductor as viewed in the stacking direction and extend in a direction substantially perpendicular to an extending direction of the first and second slots.

12. The antenna device as claimed in claim 6, further comprising a second coupler pattern electromagnetically coupled to the radiation conductor through at least the third slot.

13. The antenna device as claimed in claim 6, further comprising a first coupler pattern electromagnetically coupled to the first feed pattern.

14. The antenna device as claimed in claim 6, wherein the filter circuit includes a band-pass filter.

15. The antenna device as claimed in claim 6, wherein the antenna layer has another radiation conductor overlapping the radiation conductor as viewed in the stacking direction.

16. The antenna device as claimed in claim 6, wherein a plurality of the radiation conductors are laid out in an array.

* * * * *